US008567028B2

(12) United States Patent
Shevela et al.

(10) Patent No.: US 8,567,028 B2
(45) Date of Patent: Oct. 29, 2013

(54) INJECTOR SLEEVE REMOVAL DEVICE AND METHOD OF USE

(75) Inventors: Michael Shevela, Harrison Township, MI (US); Edward Magana, Auburn Hills, MI (US)

(73) Assignee: Service Solutions U.S. LLC, Warren, MI (US)

( * ) Notice: Subject to any disclaimer, the term of this patent is extended or adjusted under 35 U.S.C. 154(b) by 597 days.

(21) Appl. No.: 12/837,678

(22) Filed: Jul. 16, 2010

(65) Prior Publication Data

US 2011/0061217 A1 Mar. 17, 2011

Related U.S. Application Data

(60) Provisional application No. 61/243,315, filed on Sep. 17, 2009.

(51) Int. Cl.
*B25B 27/28* (2006.01)

(52) U.S. Cl.
USPC ..... 29/235; 29/238; 29/237

(58) Field of Classification Search
USPC ..... 29/235, 237, 238, 255, 270, 278
See application file for complete search history.

(56) References Cited

U.S. PATENT DOCUMENTS

| | | | | | |
|---|---|---|---|---|---|
| 1,613,577 | A * | 1/1927 | Fletcher | 409/76 |
| 1,863,045 | A * | 6/1932 | Randall et al. | 81/441 |
| 3,896,654 | A | 7/1975 | Mancini | |
| 4,280,274 | A | 7/1981 | Filer | |
| 4,796,347 | A * | 1/1989 | Aguillen et al. | 29/280 |
| 5,090,102 | A | 2/1992 | Lovell | |
| 5,201,104 | A * | 4/1993 | Winkeljann et al. | 29/256 |
| 5,365,648 | A * | 11/1994 | Fuga | 29/254 |
| 6,929,024 | B1 * | 8/2005 | Rucker | 137/315.41 |
| 7,152,509 | B2 * | 12/2006 | McCalley et al. | 81/53.2 |
| 2006/0191379 | A1 * | 8/2006 | McCalley et al. | 81/53.2 |
| 2007/0031202 | A1 * | 2/2007 | Mu et al. | 408/120 |
| 2011/0061217 | A1 * | 3/2011 | Shevela et al. | 29/235 |

* cited by examiner

*Primary Examiner* — Lee D Wilson
(74) *Attorney, Agent, or Firm* — Baker & Hostetler LLP

(57) ABSTRACT

An injector sleeve removal device including a tapered portion and a ridge. The a tapered portion having a first diameter and a second diameter. The first diameter is relatively smaller than an opening of an injector sleeve and the second diameter is relatively greater than the opening. The ridge is disposed helically about the tapered portion. The ridge is configured to cut into an inner surface of the injector sleeve and draw the tapered portion into the injector sleeve in response to rotation of the sleeve removal device.

14 Claims, 11 Drawing Sheets

INJECTOR SLEEVE REMOVAL DEVICE AND METHOD OF USE

CROSS REFERENCE TO RELATED APPLICATIONS

This application claims benefit of U.S. Provisional Application No. 61/243,315, entitled "INJECTOR SLEEVE REMOVAL DEVICE AND METHOD OF USE," filed Sep. 17, 2009, which is hereby incorporated by reference in its entirety.

FIELD OF THE INVENTION

The present invention relates generally to a device for removing injector sleeves. More particularly, the present invention relates to a device for removing injector sleeves and a method of removing injector sleeves.

BACKGROUND OF THE INVENTION

In the engine service industry, injector sleeves of diesel engines are sometimes replaced. Due to the high pressures these injector sleeves are subjected to, the sleeves are typically swaged into place. In particular, a tip portion of the injector sleeve is swaged into a bore at or just above the combustion chamber. Because the tip portion is materially deformed to mate with the bore, it is very difficult to remove the injector sleeve without damage to the engine head. Conventionally, the head of the engine is removed to gain direct access swaged tip. An appropriately sized drift pin is conventionally used to drive the injector sleeve out of the head.

Unfortunately, this process is time consuming and labor intensive. Accordingly, it is desirable to provide a device, system, and method capable of overcoming the disadvantages described herein at least to some extent.

SUMMARY OF THE INVENTION

The foregoing needs are met, to a great extent, by the present invention, wherein in some embodiments a device, system, and method of removing and/or replacing an injector sleeve are provided.

An embodiment of the present invention relates to an injector sleeve removal device. The injector sleeve removal device including a tapered portion and a ridge. The a tapered portion having a first diameter and a second diameter. The first diameter is relatively smaller than an opening of an injector sleeve and the second diameter is relatively greater than the opening. The ridge is disposed helically about the tapered portion. The ridge is configured to cut into an inner surface of the injector sleeve and draw the tapered portion into the injector sleeve in response to rotation of the sleeve removal device.

Another embodiment of the present invention pertains to a kit for replacing an injector sleeve in an engine. The kit includes an injector sleeve removal device and an injector sleeve installation assembly. The injector sleeve removal device including a tapered portion and a ridge. The a tapered portion having a first diameter and a second diameter. The first diameter is relatively smaller than an opening of an injector sleeve and the second diameter is relatively greater than the opening. The ridge is disposed helically about the tapered portion. The ridge is configured to cut into an inner surface of the injector sleeve and draw the tapered portion into the injector sleeve in response to rotation of the sleeve removal device. The an injector sleeve installation assembly including a guide, swager, and thrust bearing.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF THE INVENTION

Figure 1:
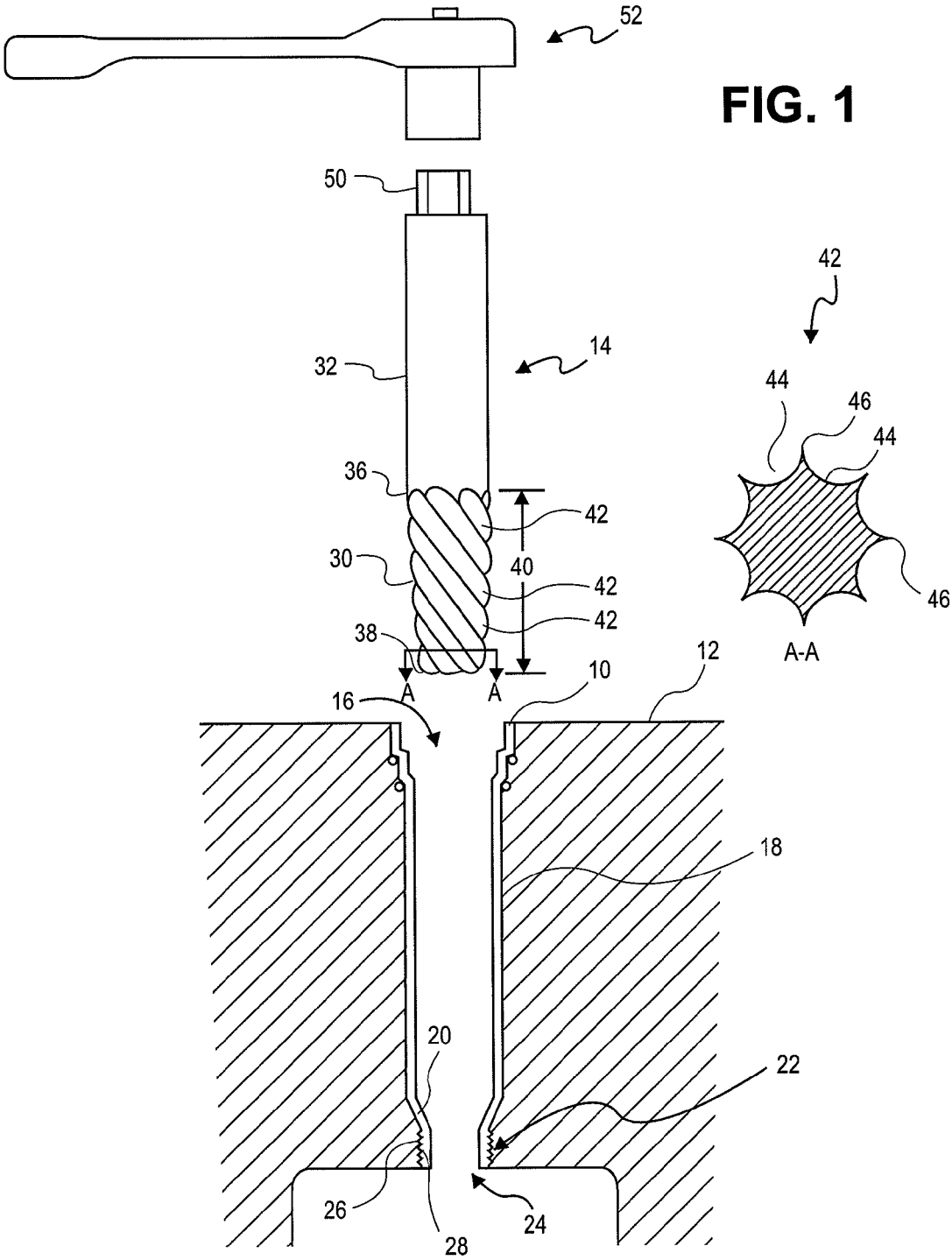
FIG. 1 is a partial cross sectional view of an injector sleeve disposed in an engine and a sleeve removal apparatus according to an embodiment of the invention.

FIG. 1 is a partial cross sectional view of an injector sleeve 10 disposed in an engine 12 and a sleeve removal device 14 according to an embodiment of the invention. As shown in FIG. 1, the injector sleeve 10 includes a first opening 16 that is approximately flush with an exterior surface of the engine 12. The injector sleeve 10 includes a body portion 18, conical portion 20, and tip 22. To secure the injector sleeve 10 in the engine 12, the tip 22 is generally swaged into a cylinder opening 24. In the particular embodiment shown in FIG. 1, the cylinder opening 24 is tapped to form female threads 26.

As such, when swaged, the tip 22 is materially deformed into the grooves of the tapped cylinder opening 24 to generate male threads 28 on the exterior surface of the tip 22. These female and male threads 26 and 28 mate or mesh to retain the injector sleeve 10 within the engine 12.

Also shown in FIG. 1, the sleeve removal device 14 includes a tapered portion 30, body portion 32, and head portion 34. The tapered portion 30 is generally frusto-conical in shape and tapers in diameter from a first diameter at a root 36 of the sleeve removal device 14 disposed proximal to the body portion 32 down to a second diameter at a tip 38 of the sleeve removal device 14. In a particular example, the tapered portion 30 may include an 8:1 long taper. However, in other examples, the taper may be more or less than 8:1 depending on a variety of factors such as material properties of the injector sleeve 10, shape and size of the injector sleeve 10, empirical data, and the like.

The tapered portion 30 includes a length 40. The diameter at the tip 38 is less than the inner diameter of the first opening 16. The diameter at the root 36 is equal to or greater than the diameter at the inner diameter of the first opening. In this manner, the tip 38 may be inserted into the first opening 16 and, at some point along the length 40, the exterior surface of the tapered portion 30 will contact the inner surface of the injector sleeve 10. The tapered portion 30 includes one or more flutes 42 which are spirally disposed upon the tapered portion 30. In general, the spiral of the flutes 42 is oriented in opposition to the threads disposed on the exterior surface of the tip 22. For example, if the threads disposed on the exterior surface of the tip 22 can be said to rotate clockwise along the tip 22, then the flutes 42 are disposed in a counterclockwise manner. Each flute 42 includes a groove 44 and a ridge 46. For example, the portion 44 may be semi-circular, "V" shaped, or the like.

As described herein, tapered portion 30 is placed partially within the injector sleeve 10 and the injector removal device 14 is rotated. In this regard, the injector removal device 14 includes a hexagonal end portion 50 configured to mate with a standard socket or wrench 52 such as ½", ¾" or similar metric size. In various examples, the wrench 52 may include a socket wrench and socket, box end, open end, adjustable wrench, or the like.

Figure 2:
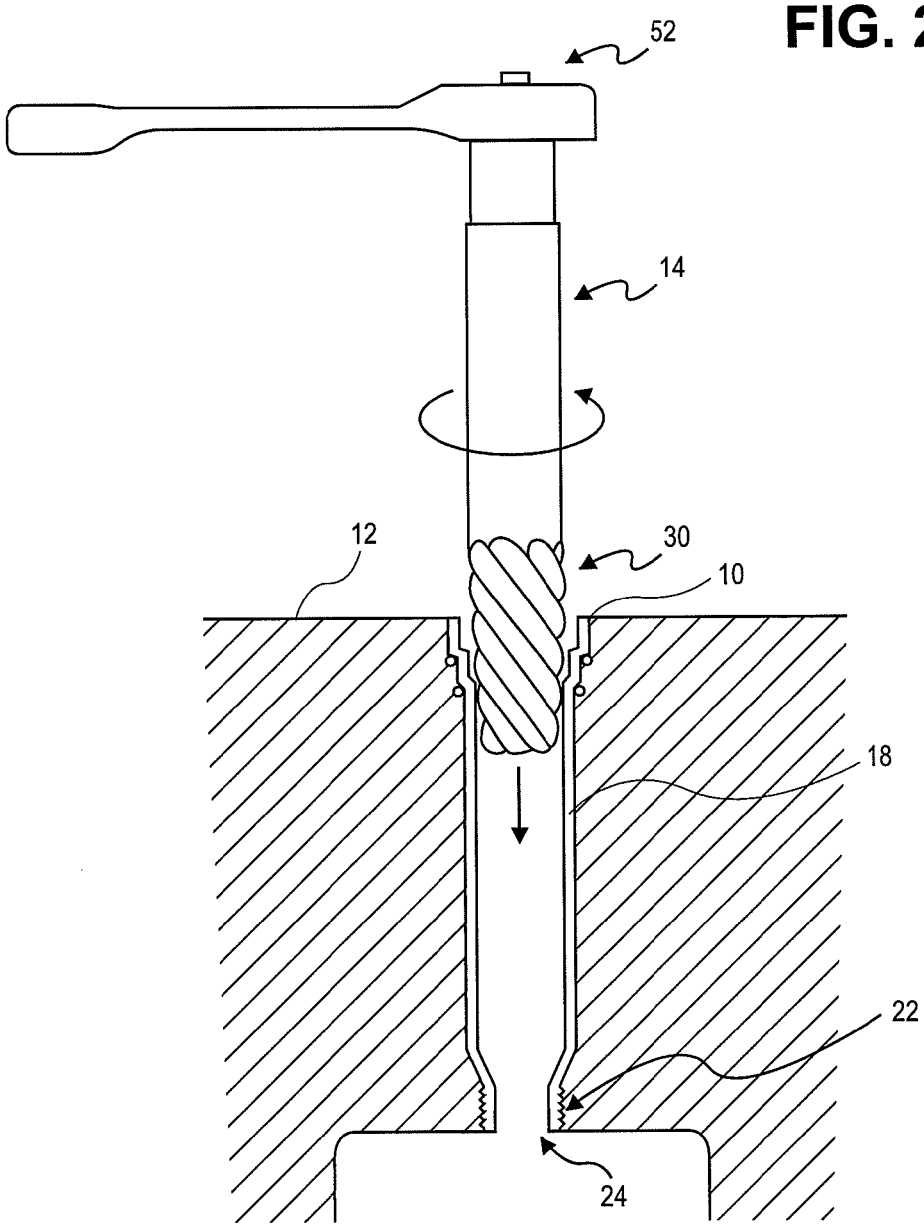
FIG. 2 is a partial cross sectional view at an initial step of removing the injector sleeve from the engine.
Figure 3:
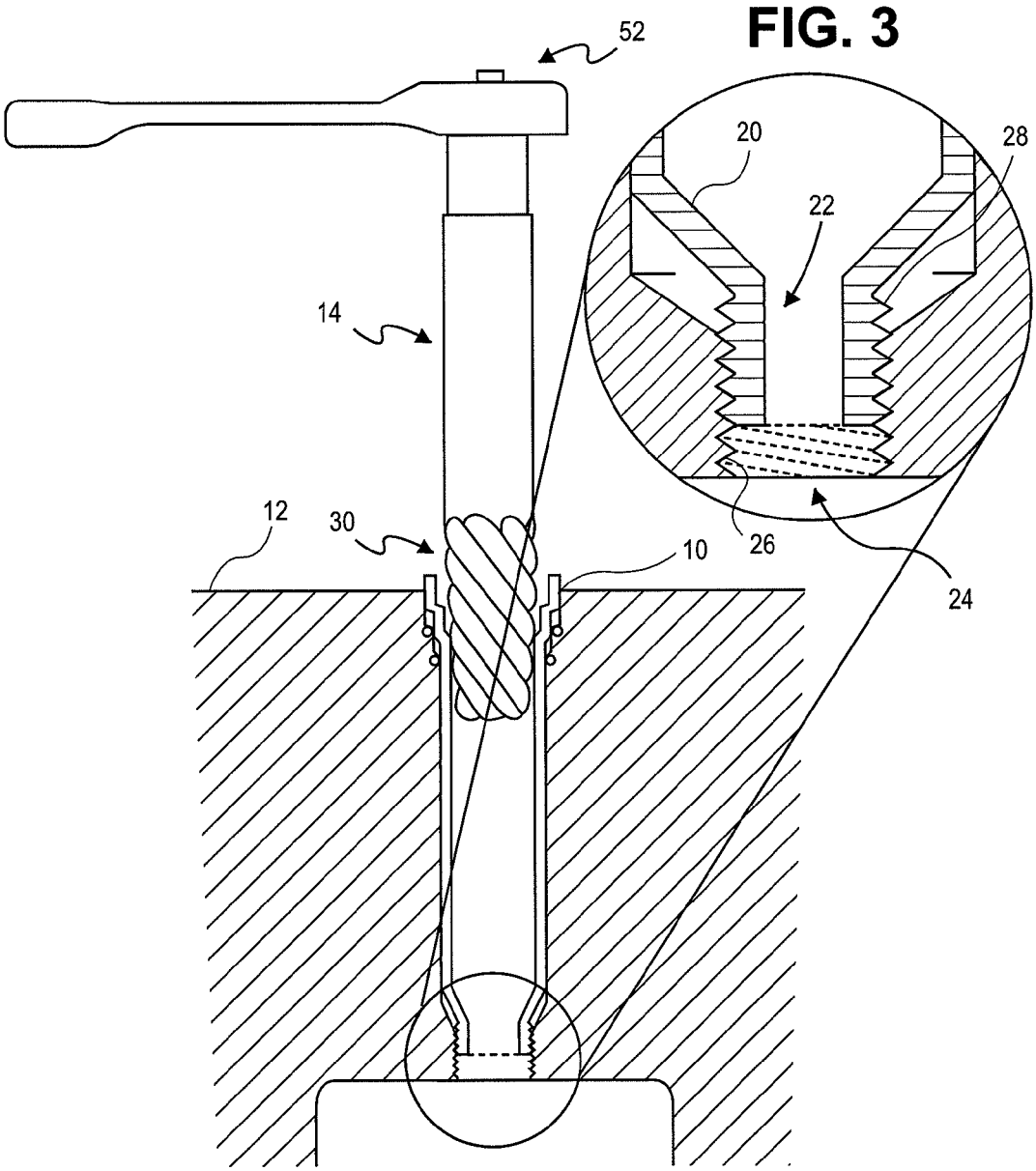
FIG. 3 is a partial cross sectional view at another step of removing the injector sleeve from the engine.
Figure 4:
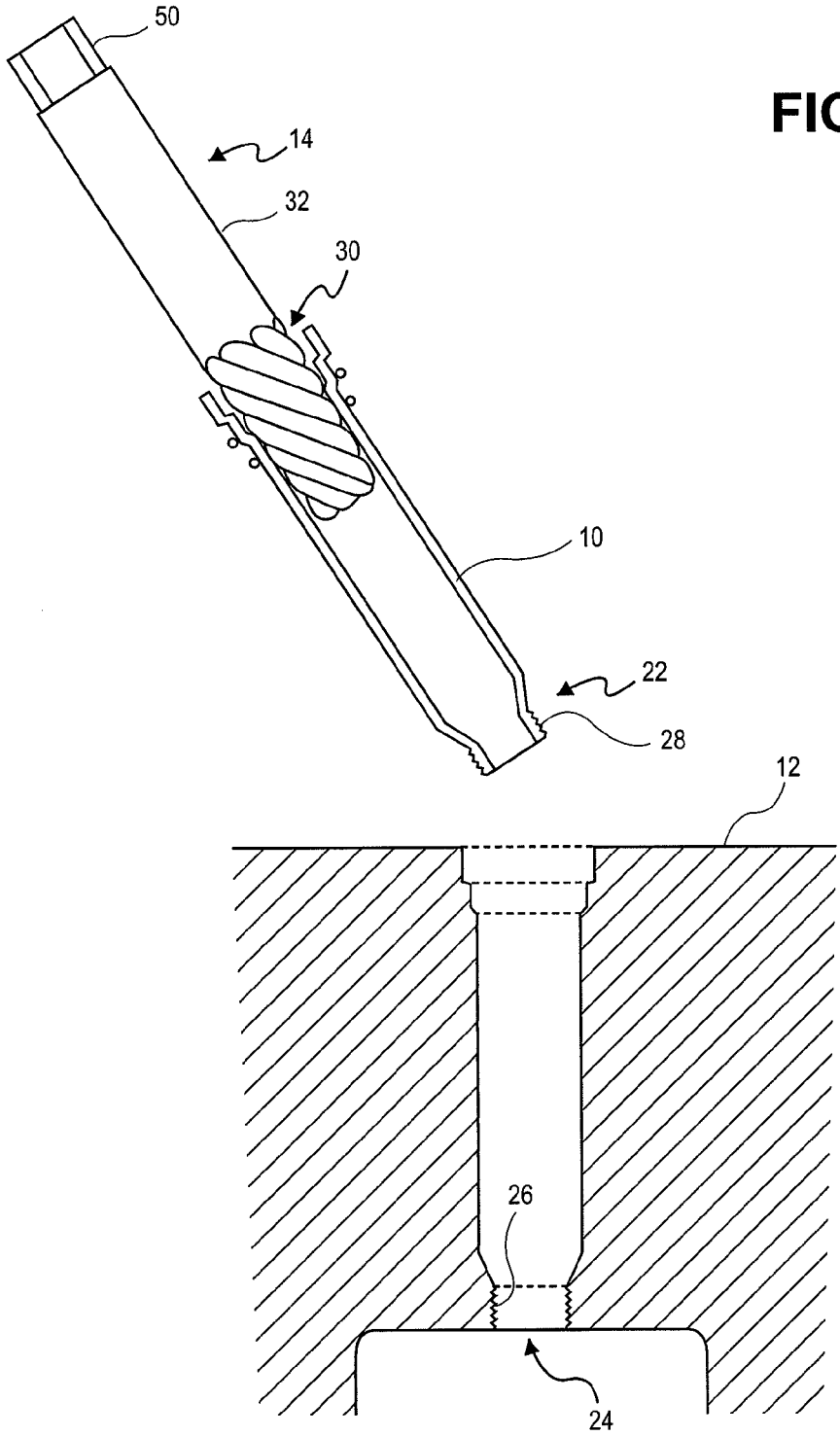
FIG. 4 is a partial cross sectional view at yet another step of removing the injector sleeve from the engine.

The ridge 46 is configured to cut into an interior surface of injector sleeve 10. For example, as shown in FIG. 2, the tapered portion may be inserted into the first opening 16 until the ridge 46 contact the inner surface of the injector sleeve 10. In response to rotating the sleeve removal device 14 in a counterclockwise manner, the ridges 46 initially cut into interior surface of the injector sleeve 10. By virtue of the helical configuration of the ridges 46, the rotation causes the ridges 46 to slide within the cuts generated in the interior surface of the injector sleeve 10 and draw the tapered portion 30 further into the injector sleeve 10. As shown in FIG. 3, this wedging action continues until the resistance to further insertion of the sleeve removal tool 14 overcomes the rotational resistance between the injector sleeve 10 and the engine 12. Once this rotational resistance is overcome, further rotation of the sleeve removal device 14 is translated into rotation of the injector sleeve 10 which, in turn, unthreads the male threads 28 from the female threads 26. This unthreading action urges the injector sleeve 10 out of the engine 12. Once the female and male threads 26 and 28 no longer intermesh, the injector sleeve 10 may be withdrawn from the engine 12 as shown in FIG. 4.

It is an advantage of various embodiments of the invention that this unthreading to remove the injector sleeve 10 reduces or eliminates the possibility of metal shaving from entering the engine cylinder. For example, if instead of the present method, the injector sleeve was drawn directly out from the engine, the male threads 28 may be cut from the tip 22 and subsequently fall into the engine cylinder. In addition, the female threads 26 may be damaged by directly drawing the injector sleeve 10 out of the engine 12.

Figure 5:
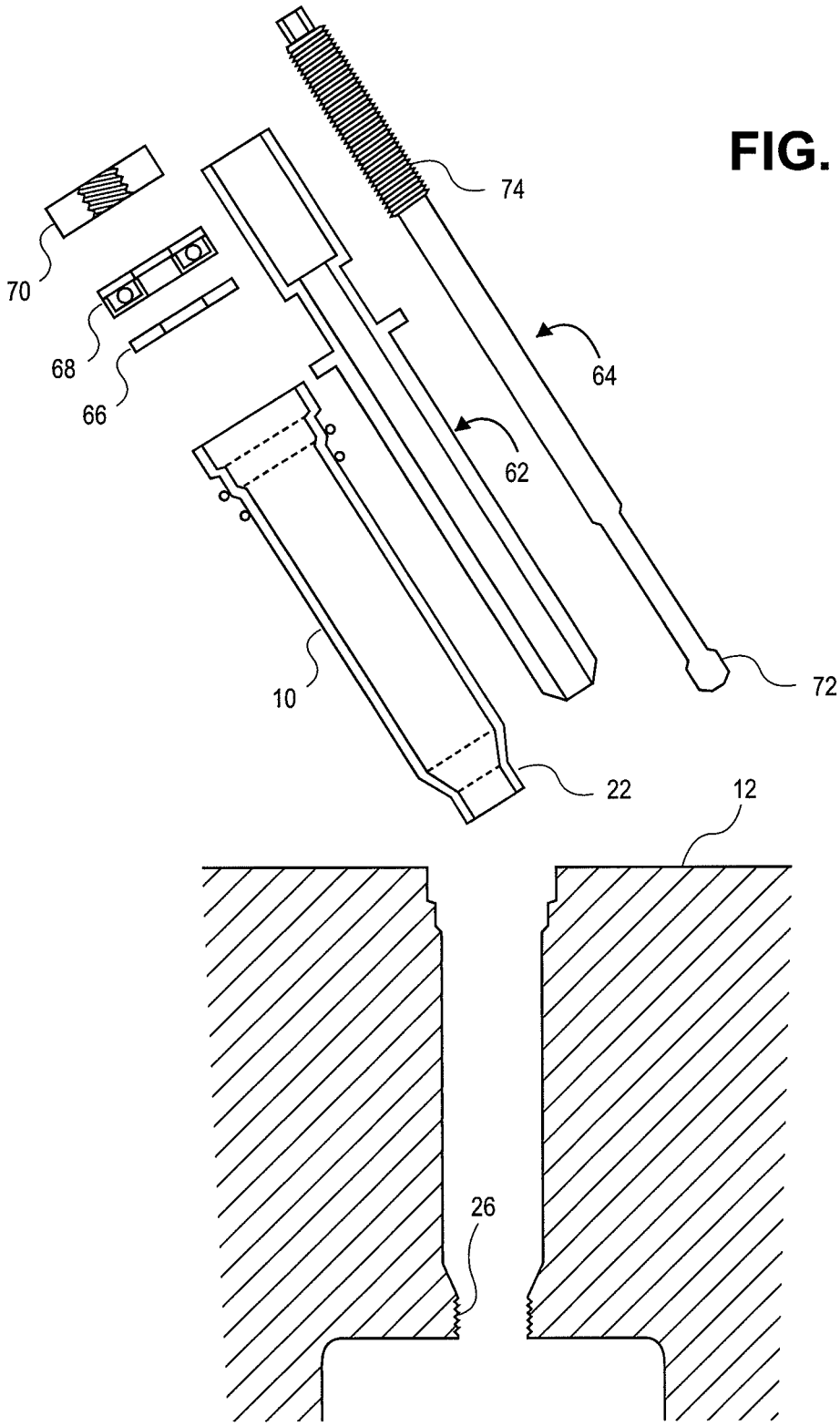
FIG. 5 is a partial cross sectional view of an injector sleeve and injector sleeve installation apparatus according to an embodiment of the invention.

FIG. 5 is a partial cross sectional view of the injector sleeve 10 and an injector sleeve installation assembly 60 according to an embodiment of the invention. As shown in FIG. 5, to install the new, unswaged, injector sleeve 10 into the engine 12, the injector sleeve installation assembly 60 includes an installer guide 62, swager 64, washer 66, thrust bearing 68, and nut 70. As shown in the following FIGS. 6-9, the injector sleeve 10 is disposed in the engine 12 and a die 72 of the swager 64, guided via the installer guide 62 is driven through the tip 22 to swage the injector sleeve 10 into the engine 12. The washer 66, thrust bearing 68, and nut 70 are then assembled on a threaded portion 74 of the swager 64 and rotated to withdraw the die 72 and free the swager 64 from the injector sleeve 10.

Figure 6:
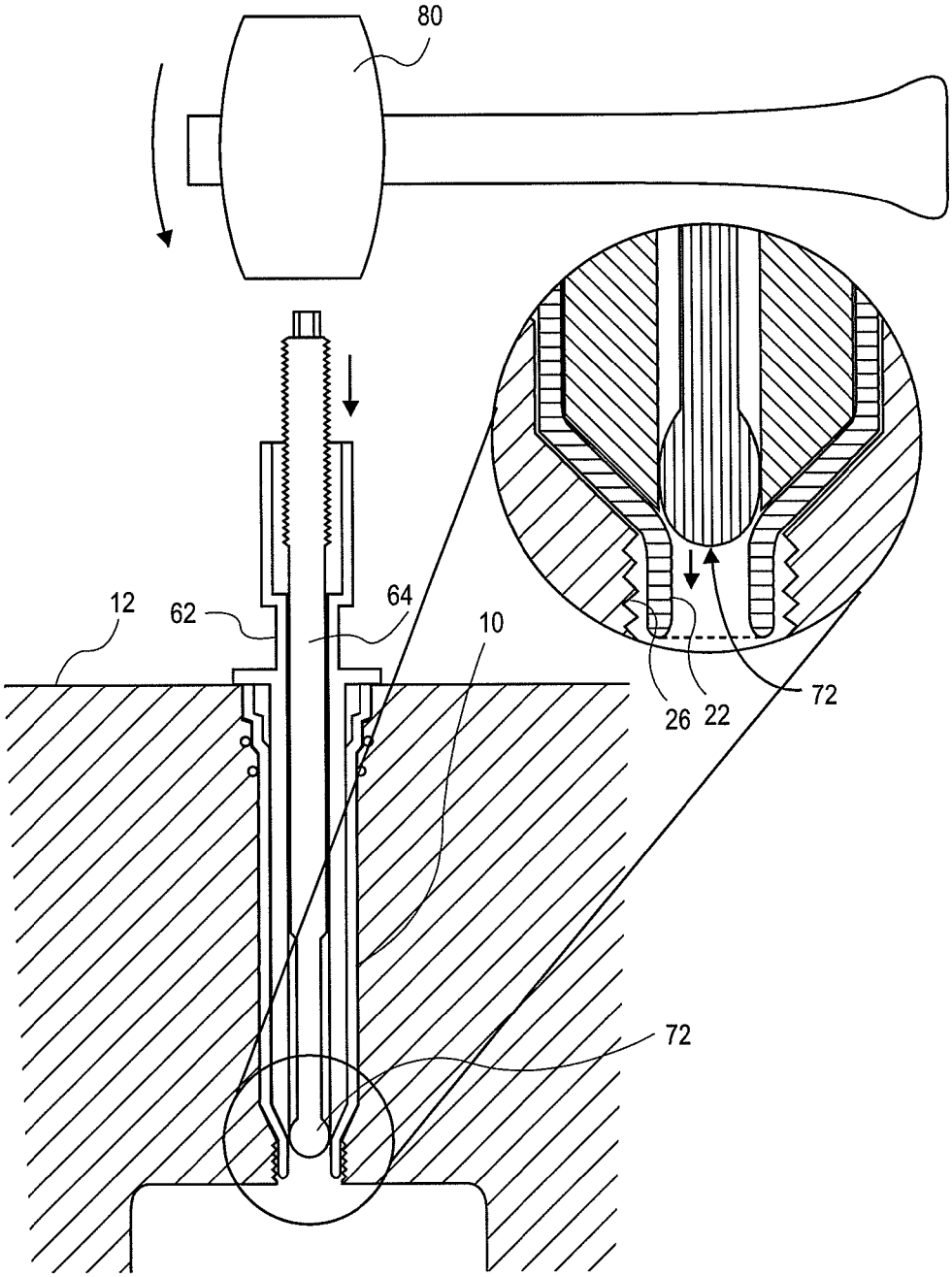
FIG. 6 is a partial cross sectional view at an initial step of installing the injector sleeve in the engine.

FIG. 6 is a partial cross sectional view at an initial step of installing the injector sleeve 10 in the engine 12. As shown in FIG. 6, the injector sleeve installation assembly 60 is assembled in the injector sleeve 10 with the die 72 disposed at or near the tip 22. A mallet 80 or other such weighted striking device may be utilized to urge the die 72 through the tip 22. However, in other examples, a press or other load generating device may be utilized to urge the die 72 through the tip 22.

Figure 7:
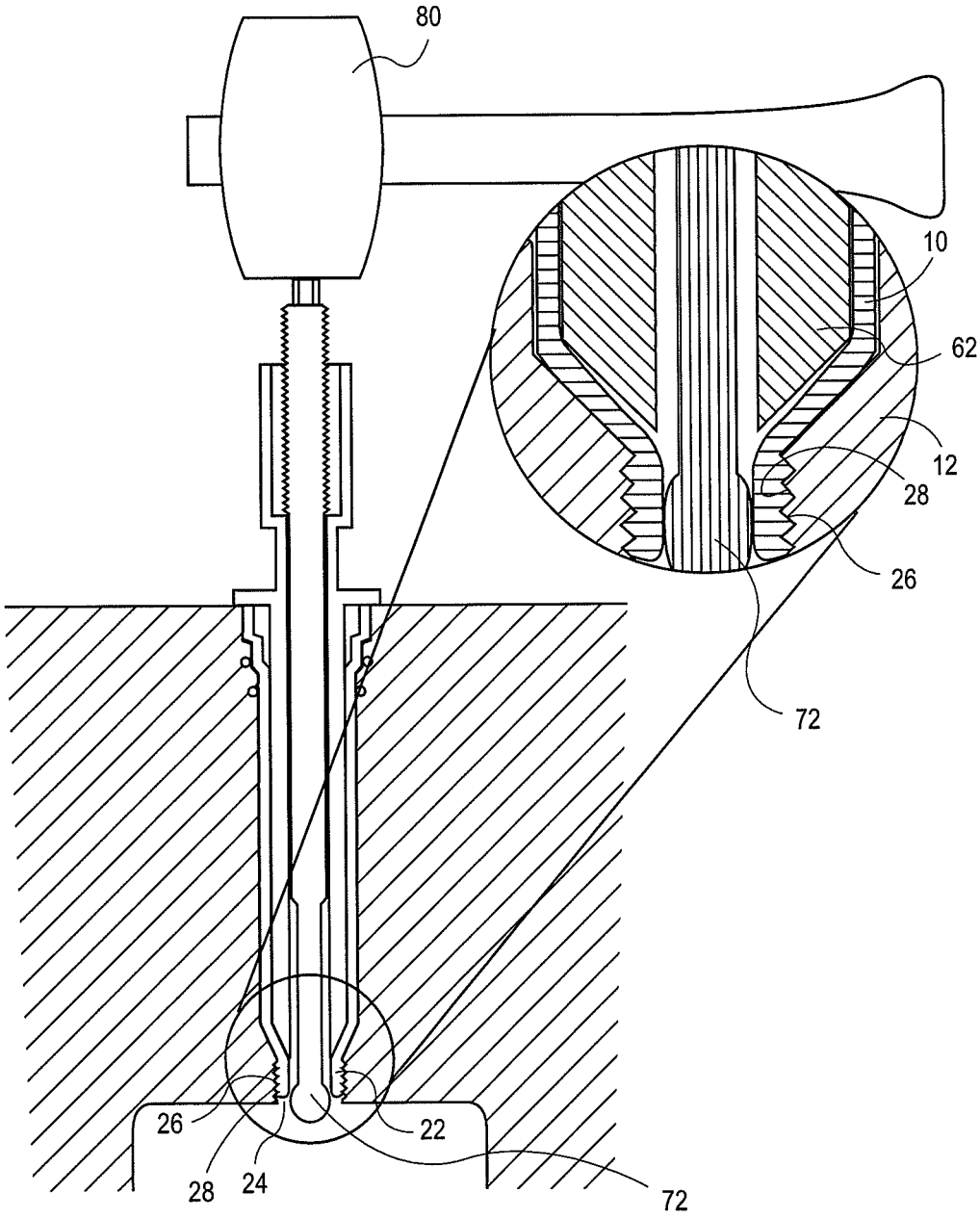
FIG. 7 is a partial cross sectional view at another step of installing the injector sleeve in the engine.

FIG. 7 is a partial cross sectional view at another step of installing the injector sleeve 10 in the engine 12. As shown in FIG. 7, the die 72 has been driven through the tip 22. In so doing, the tip 22 has been materially deformed and expanded against the cylinder opening 24. As shown in the inset of FIG. 7, the swaging process creates the male threads 28 by urging the tip 22 against the female threads 26 with sufficient force to materially deform the material of the tip 22. In this regard, the injector sleeve 10 and/or the tip 22 may include an extrudable or deformable material such as a relatively soft metal or metal alloy. In a particular example, the injector sleeve 10 and/or the tip 22 may include a copper or copper alloy.

Figure 8:
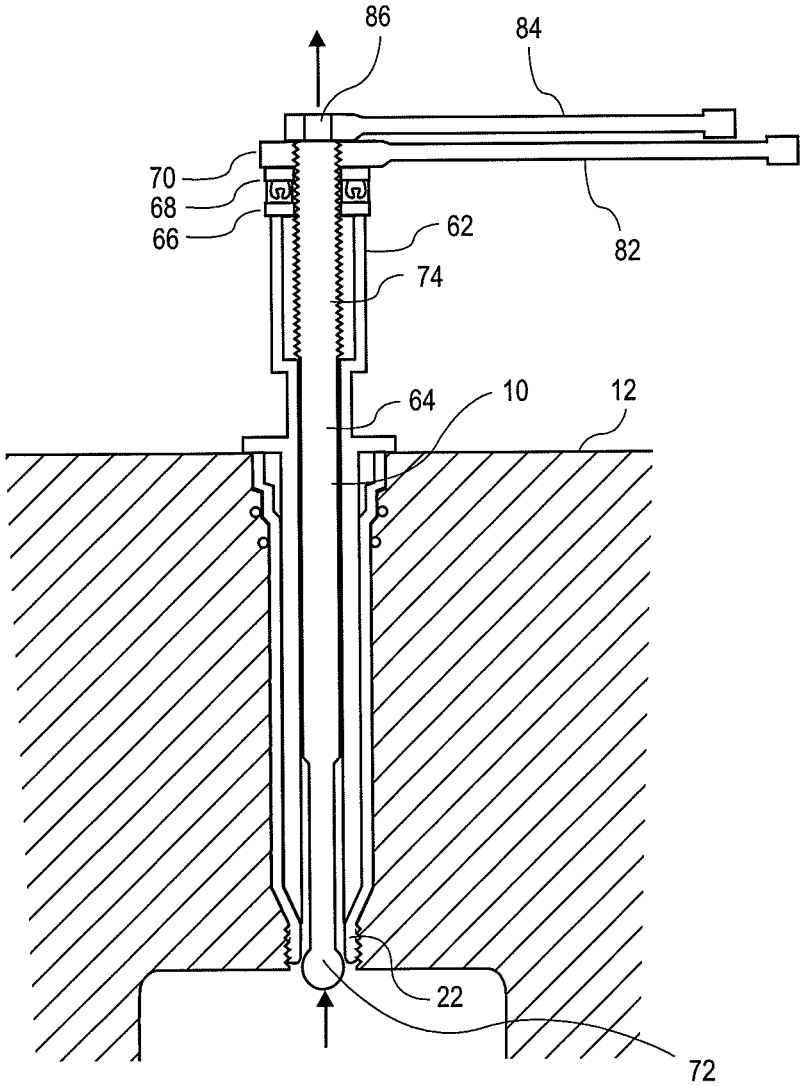
FIG. 8 is a partial cross sectional view at yet another step of installing the injector sleeve in the engine.
Figure 9:
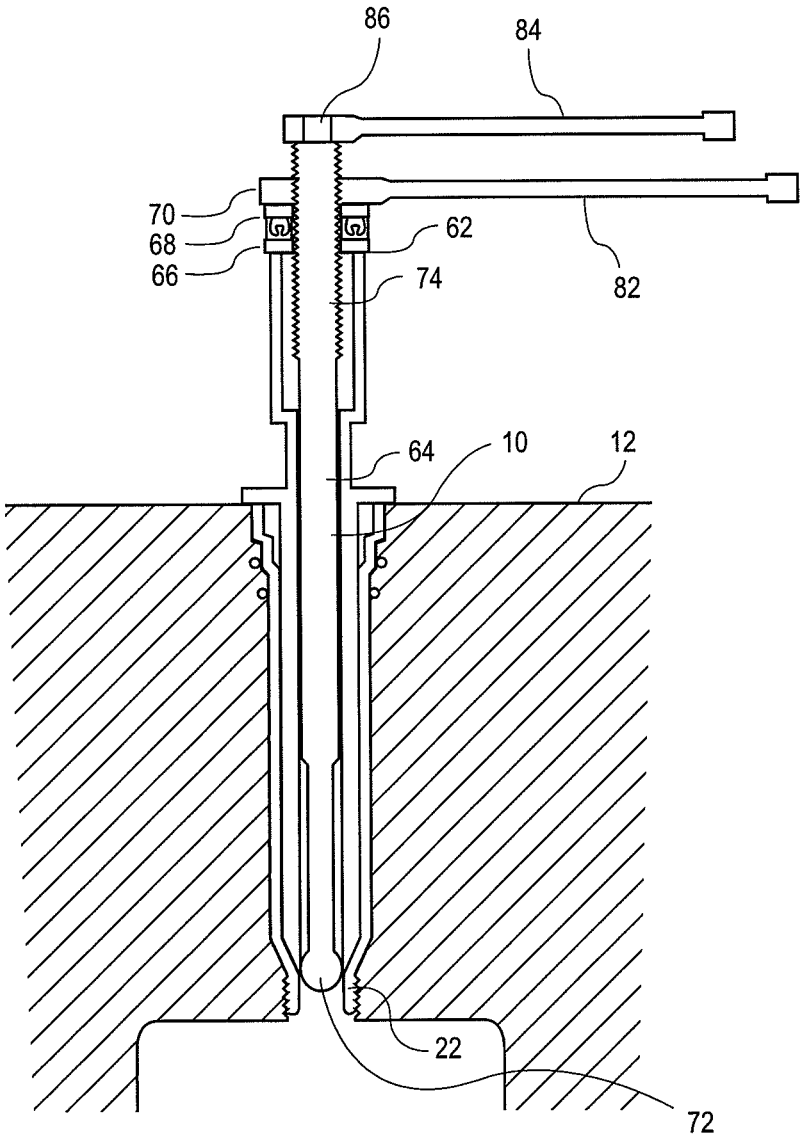
FIG. 9 is a partial cross sectional view at yet again another step of installing the injector sleeve in the engine.

FIG. 8 is a partial cross sectional view at yet another step of installing the injector sleeve 10 in the engine 12. As shown in FIG. 8, the washer 66, thrust bearing 68, and nut 70 have been assembled on the threaded portion 74. In addition, a pair of wrenches 82 and 84 are used to rotate the nut 70 while preventing the swager 64 from rotating. In this regard, the swager 64 includes a square or hexagonal end portion 86 configured to provide one or more bearing surfaces upon which the wrench 84 may bear. When assembled, the wrench 84 may be held essentially stationary while the wrench 82 is rotated. Properly assembled and executed, this procedure translates the nut 70 axially along the threaded portion 74 to bear upon the installer guide 62 via the washer 66 and thrust bearing 68. This in turn draws the die 72 back through the tip 22 which further swages the injector sleeve 10 into the engine. Eventually, as shown in FIG. 9, the die 72 is freed from the tip 22 and the injector sleeve installation assembly 60 may be removed from the injector sleeve 10

Figure 10:
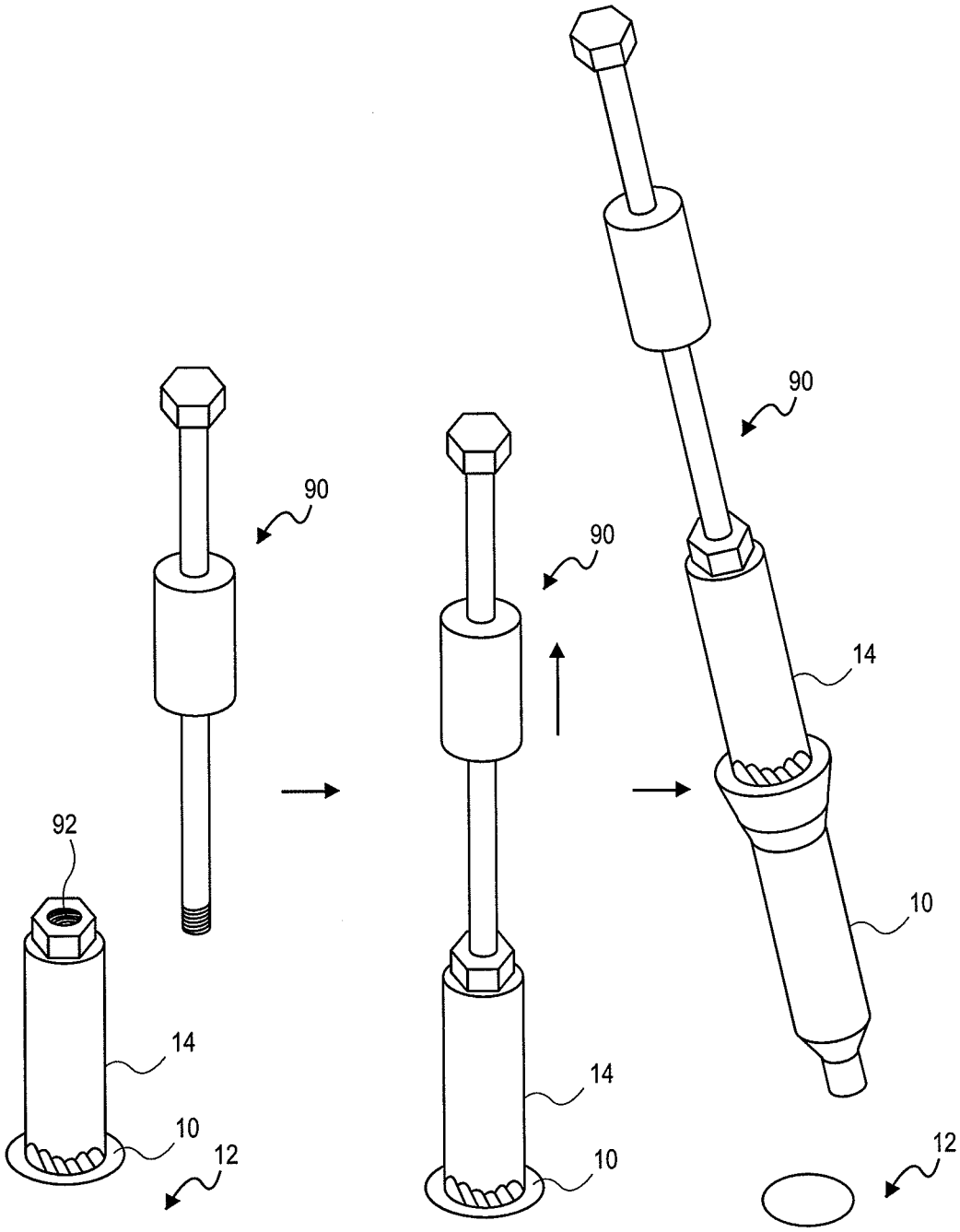
FIG. 10 is a set of perspective views illustrating an alternative method of removing the injector from the engine.

FIG. 10 is a set of perspective views illustrating an alternative method of removing the injector 10 from the engine 12. As shown in FIG. 10, a slide hammer 90 may be detachably secured to the sleeve removal device 14. In this regard, the sleeve removal device 14 may include a tapped bore 92 to receive a threaded portion 94 of the slide hammer 90. The use of slide hammers is generally well known to those skilled in the art so it will suffice to say that the slide hammer 90 is actuated to impart an outward force that draws the sleeve removal device 14 and the injector sleeve 10 out of the engine 12. In general, this slide hammer 90 may be utilized in instances in which the injector sleeve 10 is not withdrawn in response to rotation of the injector sleeve 10. For example, if the tip 22 is ablated to the point that the male threads are damaged or destroyed or the injector sleeve 10 was not sufficiently swaged during installation, the injector sleeve 10 may not be withdrawn from the engine in response to rotation. In such instances, direct withdrawal of the injector sleeve 10 may be applicable.

Figure 11:
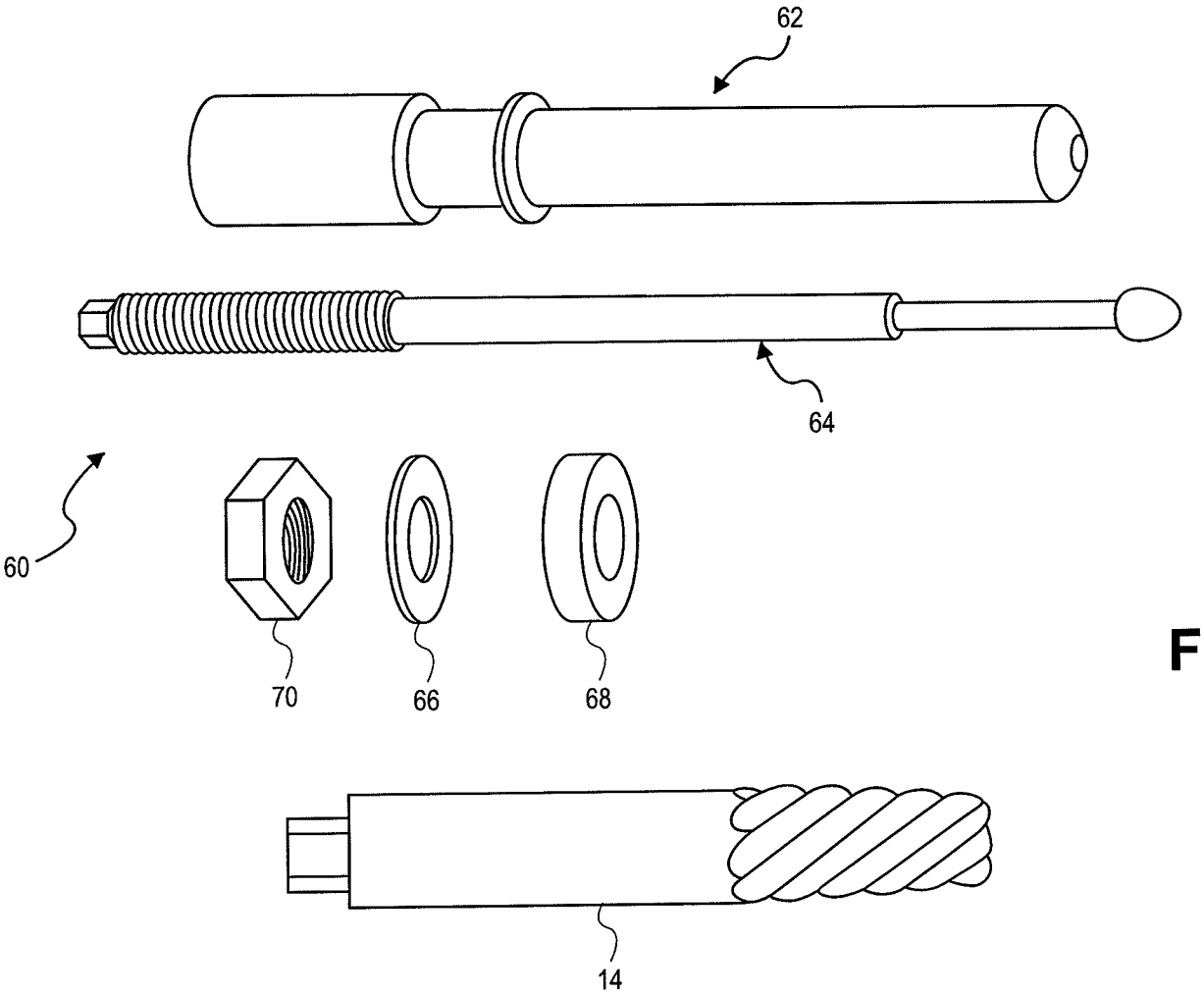
FIG. 11 is a perspective view illustrating an injector sleeve replacement kit in accordance with an embodiment of the invention.

FIG. 11 is a perspective view illustrating an injector sleeve replacement kit 100 in accordance with an embodiment of the invention. As shown in FIG. 11, the injector sleeve replacement kit 100 includes the sleeve removal device 14 and injector sleeve installation assembly 60 which includes the installer guide 62, swager 64, washer 66, thrust bearing 68, and nut 70.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. An injector sleeve removal device comprising:

a body portion;

a hexagonal head portion disposed at a first end of the body portion, the hexagonal head portion being configured to receive a wrench for rotating the sleeve removal device;

a tapered portion disposed at a second end of the body portion, the tapered portion having a first diameter and a second diameter, the first diameter being relatively smaller than an opening of an injector sleeve and the second diameter being relatively greater than the opening;

a plurality of ridges disposed helically about the tapered portion, each ridge being continuous along the tapered portion and configured to cut into an inner surface of the injector sleeve and draw the tapered portion into the injector sleeve in response to rotation of the sleeve removal device, wherein the ridge is disposed in a clockwise helix about the tapered portion and wherein counterclockwise rotation of the injector sleeve removal device draws the tapered portion into the injector sleeve and unthreads the injector sleeve from an engine block; and a plurality of flutes, each flute being interposed between ones of the plurality of ridges, wherein the plurality of flutes are semi-circular in cross-section.

2. The injector sleeve removal device according to claim 1, wherein the tapered portion includes a taper of about 8:1.

3. The injector sleeve removal device according to claim 1, further comprising:

a tapped bore disposed in the hexagonal head portion.

4. The injector sleeve removal device according to claim 1, further comprising:

a slide hammer having a rod with a threaded tip to mate with a tapped bore and a weight operable to slide upon the rod.

5. A kit for replacing an injector sleeve in an engine, the kit comprising:

an injector sleeve removal device comprising:

a tapered portion having a first diameter and a second diameter, the first diameter being relatively smaller than an opening of an injector sleeve and the second diameter being relatively greater than the opening; and a ridge disposed helically about the tapered portion, the ridge being configured to cut into an inner surface of the injector sleeve and draw the tapered portion into the injector sleeve in response to rotation of the injector sleeve removal device; and an injector sleeve installation assembly comprising:

a guide;

a swager; and a thrust bearing.

6. The kit according to claim 5, wherein the ridge is disposed in a clockwise helix about the tapered portion and wherein counterclockwise rotation of the injector sleeve removal device draws the tapered portion into the injector sleeve.

7. The kit according to claim 5, wherein the tapered portion includes a taper of about 8:1.

8. The kit according to claim 5, further comprising:

a hexagonal head portion to receive a wrench for rotating the sleeve removal device.

9. The kit according to claim 8, further comprising:

a tapped bore disposed in the hexagonal head portion.

10. The kit according to claim 5, further comprising:

a slide hammer having a rod with a threaded tip to mate with a tapped bore and a weight operable to slide upon the rod.

11. The kit according to claim 5, further comprising:

a plurality of ridges disposed helically about the tapered portion.

12. The kit according to claim 7, further comprising:

a plurality of ridges disposed helically about the tapered portion.

13. The kit according to claim 12, further comprising:

a plurality of flutes, each flute being interposed between ones of the plurality of ridges.

14. The kit according to claim 13, wherein the plurality of flutes are semi-circular in cross-section.

* * * * *